United States Patent [19]

Kelm

[11] Patent Number: 4,842,039

[45] Date of Patent: Jun. 27, 1989

[54] SELF-ALIGNING PLUNGER TIP

[76] Inventor: Otto Kelm, 3149 M-63 North, Benton Harbor, Mich. 49022

[21] Appl. No.: 211,570

[22] Filed: Jun. 27, 1988

[51] Int. Cl.[4] ..... B22D 17/08; B22D 17/20

[52] U.S. Cl. ..... 164/312; 164/314

[58] Field of Search ..... 164/312, 314; 92/187

[56] References Cited

U.S. PATENT DOCUMENTS

| | | | |
|---|---|---|---|
| 1,350,747 | 8/1920 | Stenger | 92/187 X |
| 4,154,288 | 5/1979 | Borgen | 164/312 X |
| 4,311,185 | 1/1982 | Zimmerman | 164/312 X |
| 4,598,762 | 7/1986 | Glas | 164/312 |

FOREIGN PATENT DOCUMENTS

| | | | |
|---|---|---|---|
| 2233132 | 1/1974 | Fed. Rep. of Germany | 164/312 |
| 2904883 | 7/1979 | Fed. Rep. of Germany | 164/312 |

*Primary Examiner*—Nicholas P. Godici
*Assistant Examiner*—J. Reed Batten, Jr.
*Attorney, Agent, or Firm*—Todd A. Dawson

[57] ABSTRACT

A plunger tip for use in the die casting process has an interior ball and socket arrangement wherein the plunger head is pivotable in relation to the plunger rod for correcting slight misalignments between the plunger head and the shot sleeve. A longitudinal through bore and a series of radial transverse bores are included to provide a continuous path for coolant fluid.

2 Claims, 1 Drawing Sheet

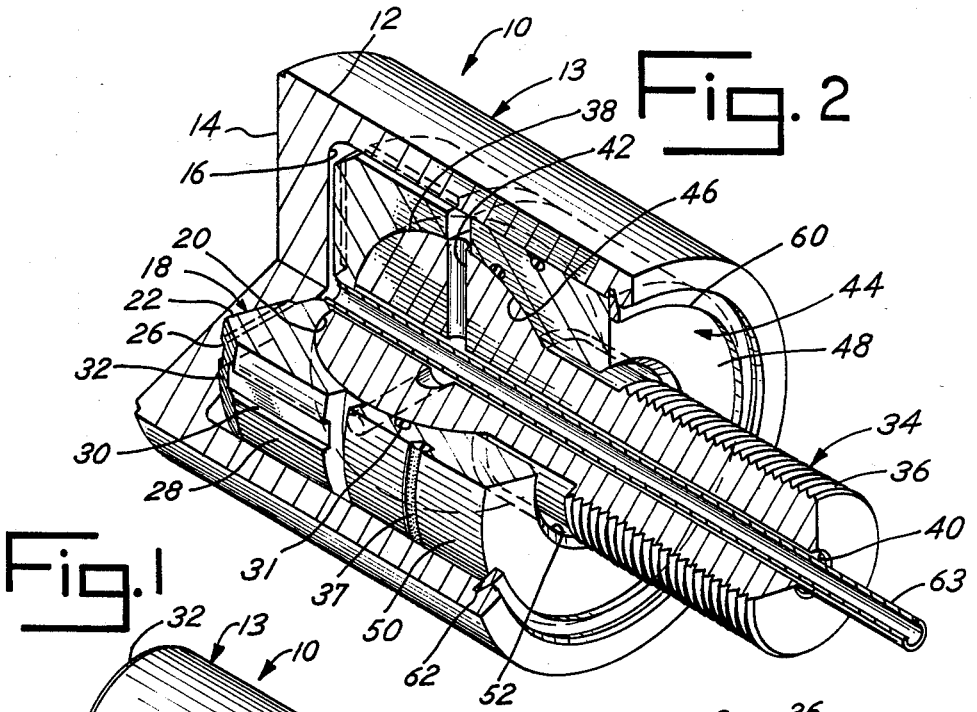
Fig. 2
Fig. 1
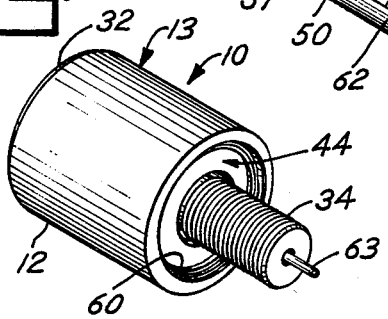
Fig. 4
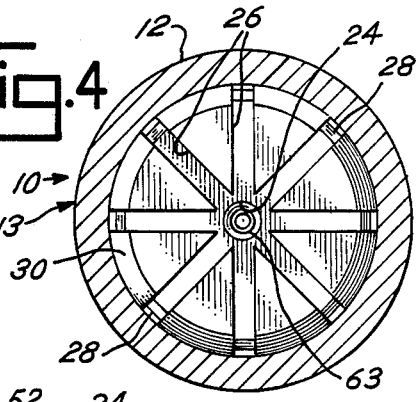
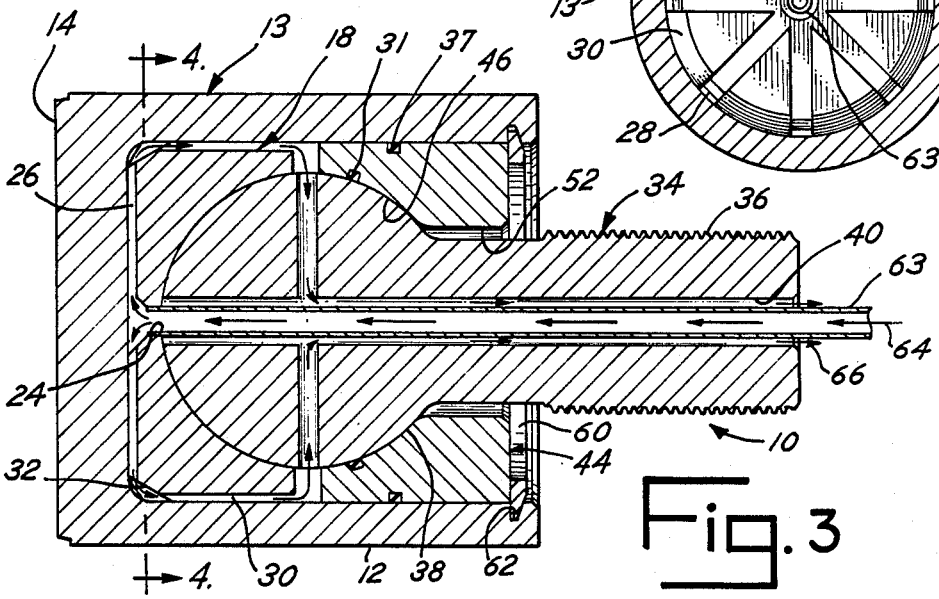
Fig. 3

SELF-ALIGNING PLUNGER TIP

SUMMARY OF THE INVENTION

This invention relates to a plunger tip used in die casting process and will have special application to a self-aligning plunger tip.

Heretofore, plunger tips used in the aluminum, magnesium and brass die casting process have been rigidly attached to a plunger rod for pushing molten metal through a shot sleeve and into a die. A problem associated with rigidly attaching a plunger tip to a plunger rod occurs when the tip and rod are slightly misaligned with respect to the shot sleeve. In such case the tip which is closely fitted to the bore of the shot sleeve, may become wedged or jammed within the shot sleeve thereby bending the plunger rod for damaging the shot sleeve and plunger tip. More commonly, the plunger tip is worn in a non-uniform way and allows molten metal to flash past the tip. The plunger tip of this invention eliminates the problems associated with the prior tips by providing a self-aligning plunger tip wherein a ball and socket arrangement is internally housed within the plunger tip which allows the tip to pivot with respect to the plunger rod to compensate for slight misalignments between the shot sleeve and plunger tip.

Another object is to allow less stringent machining tolerances of the shot sleeve, shot rod, plunger tip.

Accordingly it is an object of this invention to provide a novel plunger tip which is used for the die casting process.

Another object of this invention is to provide for a plunger tip which is pivotable with respect to the plunger rod.

Other misalignment conditions are introduced by the dynamic forces of the die casting operation, which involve high hydraulic pressures and high speed movement of the subject components. Other misalignment often occurs because the machine members which support the shot sleeve, and the plunger rod and tip, are out of alignment.

Further objects of this invention will become apparent upon a reading of the following description.

BRIEF DESCRIPTION OF THE DRAWINGS

FIG. 1 is a perspective view of the plunger tip.

FIG. 2 is an enlarged perspective view of the plunger tip with portions cut away for illustrative purposes.

FIG. 3 is a longitudinal sectional view of the plunger tip.

FIG. 4 is a cross-sectional view taken along line 4—4 of FIG. 3.

DESCRIPTION OF THE INVENTION

The preferred embodiment herein described is not intended to be exhaustive or to limit the invention to the precise form disclosed. It is chosen and described to explain the principles of the invention and its application and practical use to enable other skilled in the art to utilize the invention.

Plunger tip 10 as shown in the drawings is used in the die casing art and includes a head part 13 having an integral side wall 12 and end wall 14. Side wall 12 and end wall 14 together define an interior cavity 16. An inner socket part 18 is positioned in cavity 16 as shown. Socket 18 includes an inner hemispherical cavity 20, and an outer face 22, and a circumferential and edge 28. Inner socket part 18 is frictionally retained within cavity 16 and further defines a through bore 24. Outer face 22 of socket part 18 includes a plurality of radial channels 26 which are in flow communication with bore 24. Likewise, circumferential end edge 28 includes a plurality of channels 30 which are in communication with channels 26 of outer face 22. Socket part 18 further includes a bevelled edge 32 formed between circumferential end edge 28 and outer face 22.

A connecting rod 34 is provided to connect plunger head 13 with a plunger rod (not shown) and includes a threaded shaft portion 36 and an integral spherical head 38. Head 38 is of a sufficient radial dimension so as to fit snugly in hemispherical cavity 20 of inner socket part 18. Connecting rod 34 further includes a centrally oriented longitudinal bore 40 which is aligned with bore 24 of socket part 18. Longitudinal bore 40 preferably has a greater diameter than bore 24. Head 38 of connecting rod 34 further has a plurality of radial transverse bores 42 which are in flow communication with longitudinal bore 40 of connecting rod 34 and channels 30 of inner socket part 18.

Plunger tip 10 also includes an outer socket part 44. Outer socket part 44 is defined by concave inner face 46, outer face 48 and peripheral end edge 50 and has a central through bore 52. Concave inner face 46 complements spherical head 38. Central bore 52 of socket part 44 has a larger diameter than threaded shaft portion 36 to allow for lateral shifting movement of shaft 36. Outer socket half 44 further includes O-ring seals 31, 37 to effect a seal between spherical head 38 and outer socket part 44. A compressible snap ring 60 is accommodated within an annular groove 62 formed in side wall 12 and is positioned so as to abut outer face 48 of socket part 44 to retain inner socket part 18, connection rod 34 and outer socket part 44 in the positions illustrated in FIGS. 2 and 3.

In use, a plunger rod (not shown) is connected to shaft 36 of connecting rod 34. The plunger rod includes a tube 63 which traverses the longitudinal bore 40 of connecting rod 34 and frictionally engages bore 24 of socket part 18. Plunger rod tube 63 carries a coolant fluid in the direction of arrows 64 to provide cooling for plunger head 13 during the die casting process. As is illustrated in FIG. 3, the coolant flows toward end wall 14 where it is diverted through inner socket part channels 26 and 30 into transverse radial bores 42 of head 38. The coolant fluid exits the plunger tip in the direction of arrows 66 by flowing between tube 63 and longitudinal bore 40 to be reconditioned.

When head 13 of plunger tip 10 is inserted into a shot sleeve (not shown) for forcing molten metal toward a die, it is not uncommon for the plunger head and shot sleeve to be slightly misaligned by a matter of a few thousandths of an inch. In such a situation, connecting rod 34 pivots due to the oversize central bore 52 of outer socket part 44 upon contact with the misaligned shot sleeve (not shown) so as to automatically align the plunger head 13 with the shot sleeve.

It is to be understood that the above invention is not to be limited by the details above but may be modified within the scope of the appended claims.

The outer shell is made of commonly used copper or steel alloys.

I claim:

1. A plunger tip for use in a die casting process having an exterior wall and an end wall defining a cavity, means carried within said cavity for connecting said plunger tip to a plunger rod, said connecting means having a bore therethrough in communication with said cavity for ingress and egress of a coolant, the improvement wherein said connecting means includes a socket part defining a spherical cavity being retained within the first mentioned cavity, said socket part further defining an outer bore in communication with said cavity, a rod member having a spherically tipped end and a connecting shaft through said outer bore into said socket part wherein said spherically tipped and is pivotally acommodated within said spherical cavity, said shaft of said rod member being of a smaller dimension than said socket part outer bore for accommodating shiftable movement of said rod member relative to said socket part, and means for cooling said plunger tip, said cooling means including a plurality of channels defined about the periphery of said socket part, said socket part defining a second through bore opposite the first mentioned bore and in flow communication with said channels, said cooling means further including a longitudinal bore defined in said rod member and a plurality of transverse bores formed in said spherically tipped end communicating with said longitudinal bore, said longitudinal bore and said transverse bores constituting a flow path for injection of a coolant into said plunger tip.

2. The plunger tip of claim 1 wherein said cooling means further includes a plurality of radially extending channels formed in said socket part adjacent said plunger tip end wall and interconnecting said socket part peripheral channels and said second through bore for directing coolant over said plunger tip end wall.

* * * * *